US008933639B2

(12) United States Patent
Bianco et al.

(10) Patent No.: US 8,933,639 B2
(45) Date of Patent: Jan. 13, 2015

(54) DEVICE AND METHOD FOR DIMMING LIGHT SOURCES

(75) Inventors: Francesco Bianco, Spinea (IT); Alessandro Bizzotto, Castelfranco Veneto (IT); Paolo De Anna, Vallà di Riese Pio X (IT); Alessandro Scordino, Dolo (IT); Nicola Zanforlin, Campodarsego (IT)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 526 days.

(21) Appl. No.: 12/712,257

(22) Filed: Feb. 25, 2010

(65) Prior Publication Data

US 2010/0219763 A1 Sep. 2, 2010

(30) Foreign Application Priority Data

Feb. 27, 2009 (IT) ..... TO2009A0146

(51) Int. Cl.
*H05B 37/02* (2006.01)
*D06F 39/00* (2006.01)
*H05B 33/08* (2006.01)

(52) U.S. Cl.
CPC ..... *D06F 39/006* (2013.01); *H05B 33/0815* (2013.01)
USPC ..... 315/224; 315/185 R; 315/250; 315/291; 315/294; 315/312

(58) Field of Classification Search
USPC ..... 315/294, 291, 307, DIG. 4, 185 R, 224, 315/312, 254, 250
See application file for complete search history.

(56) References Cited

U.S. PATENT DOCUMENTS

| | | | | |
|---|---|---|---|---|
| 3,959,714 | A | 5/1976 | Mihelich | |
| 6,542,344 | B1 | 4/2003 | Mashiko | |
| 6,911,808 | B1 * | 6/2005 | Shimamori | 323/283 |
| 7,072,191 | B2 * | 7/2006 | Nakao et al. | 323/282 |
| 7,102,340 | B1 * | 9/2006 | Ferguson | 323/284 |
| 7,542,257 | B2 * | 6/2009 | McCormick et al. | 361/91.1 |
| 7,944,153 | B2 * | 5/2011 | Greenfeld | 315/291 |
| 8,076,920 | B1 * | 12/2011 | Melanson | 315/247 |
| 8,174,204 | B2 * | 5/2012 | Melanson | 315/291 |
| 2007/0188112 | A1 * | 8/2007 | Kang et al. | 315/291 |
| 2008/0197789 | A1 | 8/2008 | Shiotsu et al. | |
| 2008/0224625 | A1 | 9/2008 | Greenfeld | |
| 2009/0015172 | A1 * | 1/2009 | Huang et al. | 315/246 |
| 2009/0160422 | A1 * | 6/2009 | Isobe et al. | 323/349 |

FOREIGN PATENT DOCUMENTS

| | | | |
|---|---|---|---|
| JP | 2002247864 | A | 8/2002 |
| JP | 2007287617 | A | 11/2007 |
| KR | 100731393 | B1 | 6/2007 |

OTHER PUBLICATIONS

Italian Search Report of Sep. 10, 2009.

* cited by examiner

*Primary Examiner* — Douglas W Owens
*Assistant Examiner* — Thai Pham

(57) ABSTRACT

In various embodiments, a device for dimming a light source is provided. The device may include a two-wire power supply line having interposed therein a switch for controlling transfer of the power supply towards the light source; a capacitance located downstream of the switch being traversed by a charge current as the switch is switched on; and a pre-charge stage interposed between the switch and the capacitance; the pre-charge stage being configured to limit to a given value the charge current.

11 Claims, 4 Drawing Sheets

DEVICE AND METHOD FOR DIMMING LIGHT SOURCES

CROSS-REFERENCE TO RELATED APPLICATION

This application claims priority to Italian Patent Application Serial No. TO2009A000146, which was filed Feb. 27, 2009, and is incorporated herein by reference in its entirety.

TECHNICAL FIELD

Various embodiments relate to the techniques for dimming light sources. The description has been prepared with particular attention to the potential application in light sources that use light-emitting diodes (LED), for example high-current LEDs.

BACKGROUND

The block diagram in FIG. 1 refers to a "three wire" dimming solution. In the block diagram in FIG. 1, the reference S indicates a light source fed via a driver D connected to three wires, specifically:

- a pair of wires 10 that supply power (taking it, for example, from a continuous voltage source), and
- a third wire 12 carrying a pulse width modulated (PWM) control signal that commands the dimming function.

The power supplied via the pair of wires 10 is in fact a continuous power supply and the driver D transfers the power to the source S as a function of the PWM signal on the wire 12, in particular as a function of its duty cycle: the luminosity of the source S is in fact a function of the average intensity of the current flowing through the source S, an intensity that in turn depends on the duty cycle of the control signal.

The block diagram in FIG. 2 refers instead to a system in which the dimming function is realized with a "two wire" system interposing on at least one of the wires of the pair 10 a switch T (for example an electronic switch such as a MOSFET) that is opened and closed using a PWM control signal.

In this case, the power supply of the driver D is no longer continuous but intermittent as schematized in FIG. 3, including two parts indicated respectively with a) and b). The two parts of FIG. 3 are two diagrams that illustrate as a function of a single time scale (x-axis scale, indicated with t), respectively:

- the closed, i.e. conductive ("Ton"), or open, i.e. non-conductive ("Toff"), state of the switch T, and
- the ideal flow of the supply power to the driver D.

In the drawing in FIGS. 2 and 3, the dimming function is therefore implemented by controlling, using PWM, the power supply line 10 interrupting in a controlled manner the electrical power to the driver D. By controlling the switching frequency of the switch T such that it is higher than the sensitivity range of the human eye (related to the persistence of the image on the retina), the overall effect achieved is to make the light source S, a function of the average intensity of the current flowing through the source S, dependent on the duty cycle of the PWM signal used to turn the switch T on and off.

Compared to the "three wire" drawing in FIG. 1, the "two wire" drawing in FIG. 2 presents the advantage of doing without one of the wires, which makes the circuit simpler and cheaper. Furthermore, the use of the circuit in FIG. 2 must take into account the presence, at the input of the driver D, of the capacitance C observable as a whole downstream of the switch T, capacitance which may also include at least one capacitor included in the input stage of the driver D.

In operation of the circuit, when the switch T is open, i.e. not conductive, the capacitance C supplies power to the driver D, with the resulting reduction in the voltage present in that capacitance. When the switch T is made conductive again, a voltage step creating an inrush current is applied to the capacitance C. The peak value of this current is nominally limited only by the parasitic resistance of the power supply line including the switch T and the capacitance C and is a function of the width of the aforementioned voltage step, this being the difference between the input voltage from the power source (or the source powering the line 10) and the residual voltage on the capacitance C when the switch T is closed again. This voltage step is therefore a function of the value of the capacitance C and the switching speed (frequency) of the switch T.

SUMMARY OF THE INVENTION

In various embodiments, a device for dimming a light source is provided. The device may include a two-wire power supply line having interposed therein a switch for controlling transfer of said power supply towards said light source; a capacitance located downstream of said switch being traversed by a charge current as said switch is switched on; and a pre-charge stage interposed between said switch and said capacitance; said pre-charge stage being configured to limit to a given value said charge current.

BRIEF DESCRIPTION OF THE DRAWINGS

In the drawings, like reference characters generally refer to the same parts throughout the different views. The drawings are not necessarily to scale, emphasis instead generally being placed upon illustrating the principles of the invention. In the following description, various embodiments are described, purely by way of a non-limiting example, with reference to the attached figures, in which.

DESCRIPTION

The description below illustrates various specific details to provide a more comprehensive understanding of the embodiments. The embodiments may be realized without one or more of the specific details, or with other methods, components, materials, etc. In other cases, known structures, materials or operations are not shown or described in detail so as not to obscure the different aspects of the embodiments.

Reference to "an embodiment" in this description indicates that a particular configuration, structure or characteristic described in relation to the embodiment is included in at least one embodiment. Therefore, phrases such as "in one embodiment", which may appear in various places in this description, do not necessarily refer to the same embodiment. Furthermore, specific formations, structures or characteristics may be appropriately combined in one or more embodiments.

The references used herein are used solely for convenience and therefore do not define the field of protection or scope of the embodiments.

Figure 1:
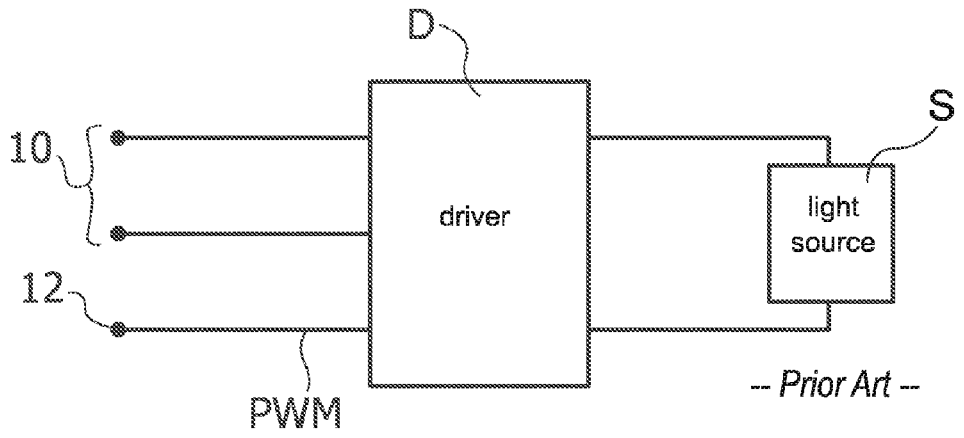
FIG. 1 illustrates a block diagram of a "three wire" dimming solution.
Figure 2:
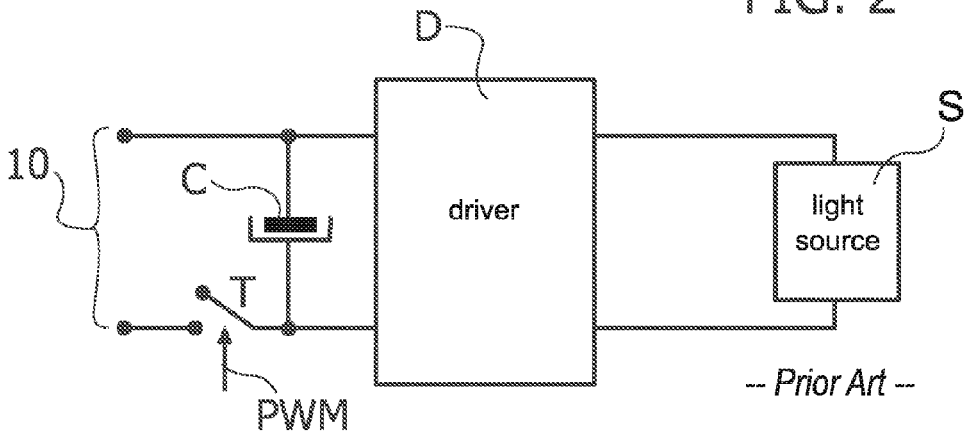
FIG. 2 illustrates a block diagram of a "two wire" system in which a dimming function is realized.
Figure 3:
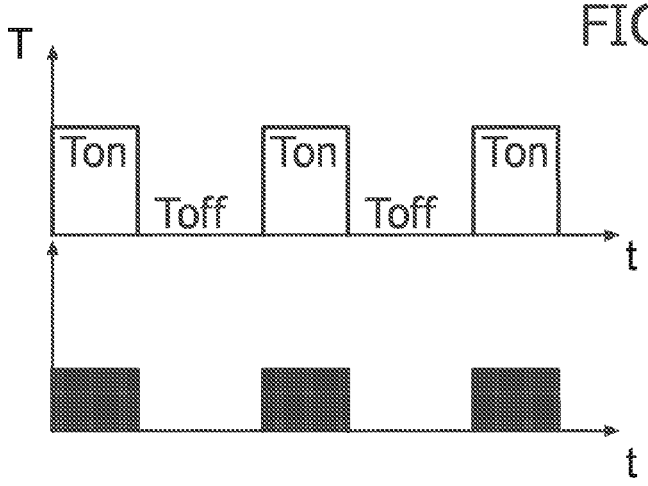
FIG. 3 illustrates the closed or open state of a switch and the ideal flow of a supply power to a driver.

From FIG. 4 onwards, parts, elements or components identical or equivalent to parts, elements or components already described with reference to FIGS. 1 to 3 are marked with the same references, making it unnecessary to repeat the related descriptions.

Figure 4:
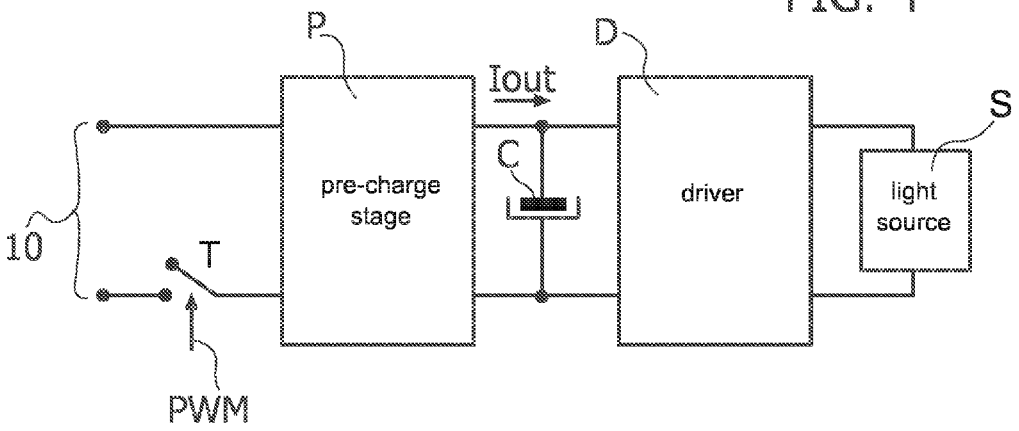
FIG. 4 is a block diagram of a preferred aspect of the disclosure.

It shall also be seen that, in some embodiments, the basic solution illustrated in FIG. 4 (interposing between the switch T and the capacitance C a pre-charge stage intended to limit—with an on/off function or with continuous adjustment—the inrush current on closure of the switch T) may advantageously use one or more components already present in the basic drawing in FIG. 2.

Figure 5:
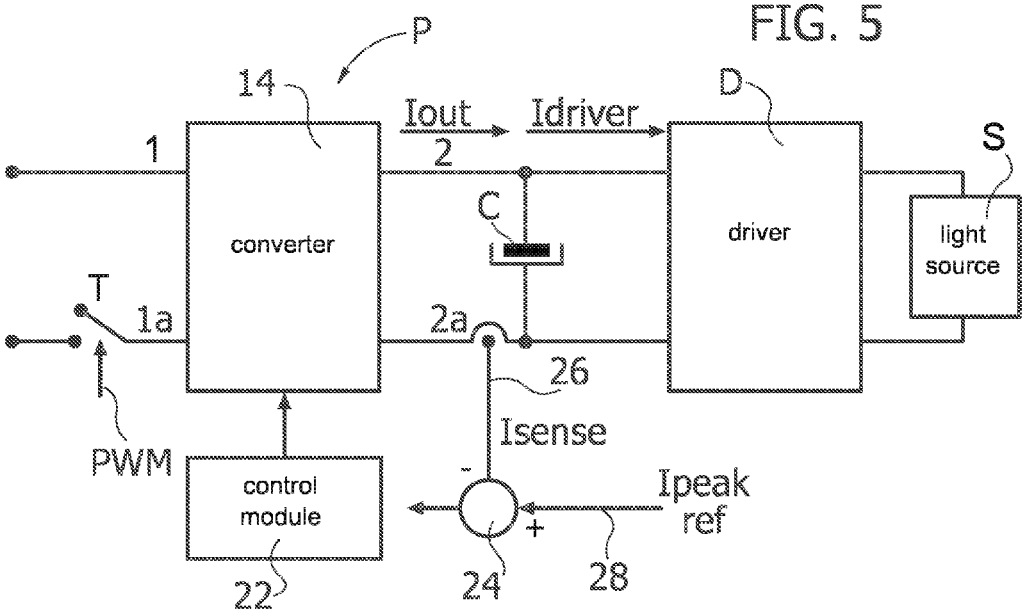
FIG. 5 illustrates one aspect of the disclosure.
Figure 6:
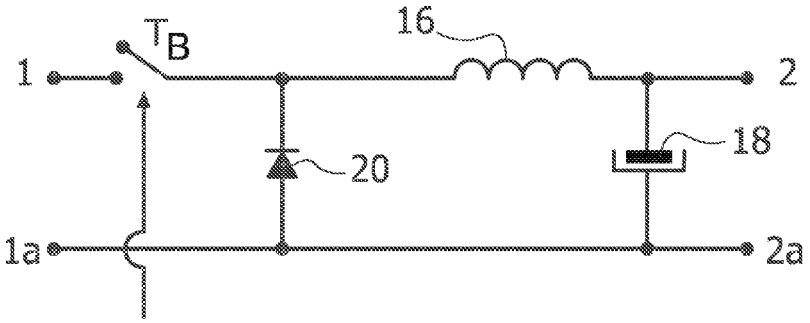
FIG. 6 illustrates another aspect of the disclosure, FIG. 7, including four temporarily superposed diagrams, marked respectively a), b), c) and d), illustrates the temporary trend of certain signals present in the device in FIG. 4.

In various embodiments, FIGS. 5 and 6 refer to an embodiment in which the pre-charge stage P is implemented around a "buck" converter 14 inserted in a negative-feedback drawing.

The drawing in FIG. 6 shows a possible embodiment of the buck converter 14, containing a low-pass LC module comprising an inductor 16 and a capacitor 18 (in fact, arranged in parallel with the capacitance C and potentially included in said capacitance). The converter 14 may also include a diode 20 connected to the LC module 16, 18 a π configuration with the cathode of the diode 20 connected to the inductor 16.

The reference $T_B$ indicates a control switch that permits/prevents (respectively when closed, i.e. conductive, and when open, i.e. non-conductive) the transfer of power from the line 10 to the driver D. As a result, even though the switch $T_B$ is shown here as a separate component, in one embodiment its function may be incorporated into the function of the switch T.

The switch $T_B$ is commanded by a control module 22 that receives, via a difference node 24, a signal representative of the difference between the intensity of the current Iout flowing from the stage P to the capacitance C (signal Isense—line 26) and a peak reference current value (Ipeak ref—line 28).

Figure 7:
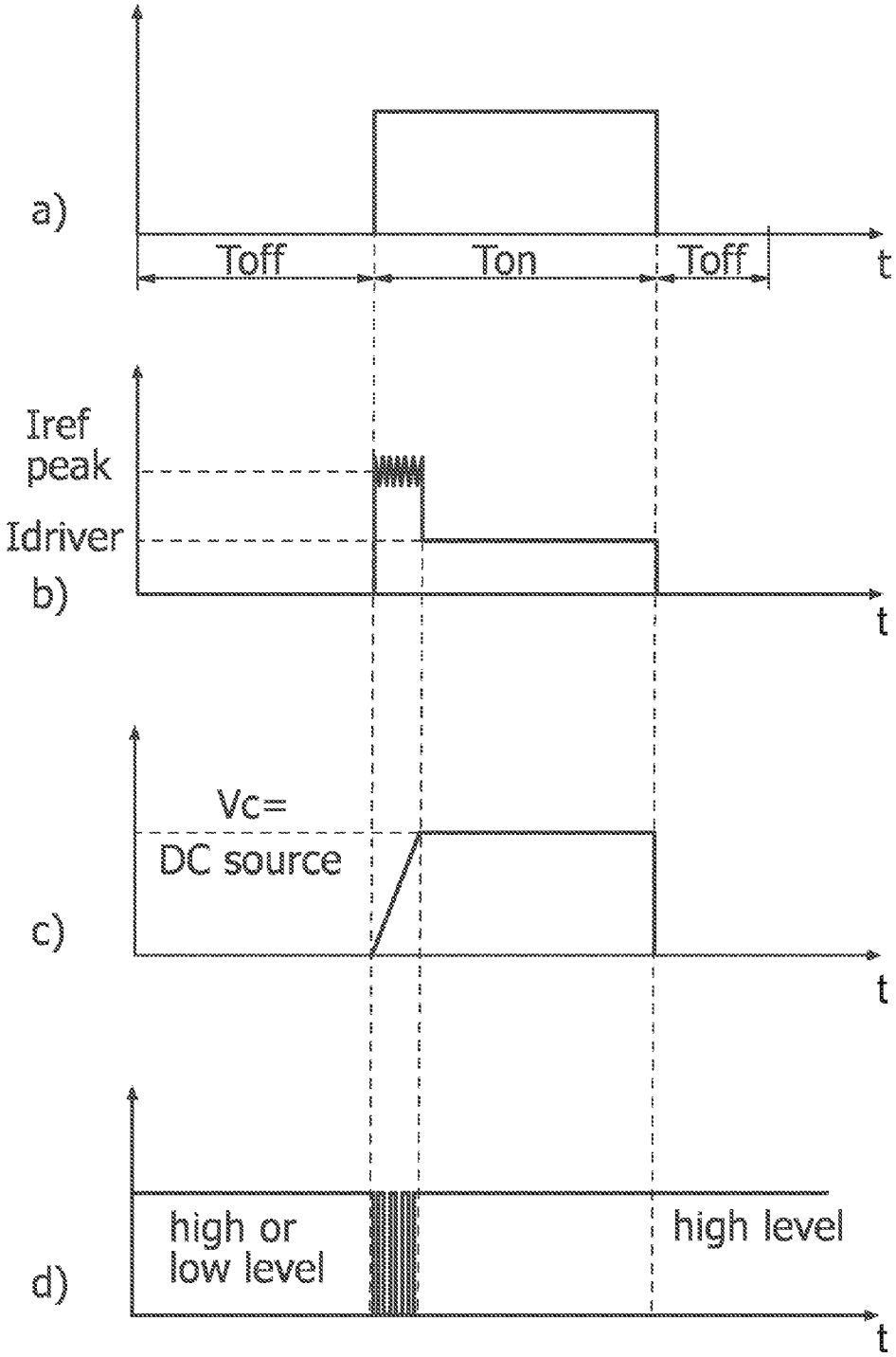

In diagram a) of FIG. 7, Toff indicates the period of time for which the switch T is open, i.e. non-conductive; Ton however indicates the period of time for which the switch T is closed, i.e. conductive. The ratio Ton/(Ton+Toff) therefore indicates the duty cycle of the PWM control signal of the switch T used to command the dimming function of the source S.

In one embodiment, the control law implemented by the module 22 states that at the instant the switch T is closed (moving from Toff period to Ton period in diagram a) of FIG. 7) the switch $T_B$ is also closed thereby allowing the capacitance C (and the capacitor $C_B$ in FIG. 6) to be charged by the current Iout.

The sensing action performed via the line 26 makes it possible to adjust the intensity of the current Iout so that it does not exceed—at least in terms of the average value—the maximum peak value (Ipeak ref) set for the line 28.

In one embodiment, the module 22 is configured such that when the intensity of the charge current Iout sensed as Isense on the line 26 reaches the peak value Ipeak ref set for the line 28 (which causes the output signal produced by the node 24 to drop to zero) the module 22 opens the switch $T_B$ interrupting the current flow across it.

This operating mode results in a sequence of opening and closing cycles of the switch $T_B$ (at a frequency greater than the frequency of the PWM signal driving the switch T) as shown in diagram d) of FIG. 7.

The practical result is as shown in diagram b) of FIG. 7, i.e. keeping the intensity of the current (average value) flowing out of the stage P (current Iout) within the reference value set Ipeak ref. All of which results in the charging of the capacitance C according to an at least approximately linear gradient, of the type shown in diagram c) of FIG. 7.

The intervention of the control switch $T_B$ concludes when the capacitance C is fully charged, at the end of the gradient in diagram c) of FIG. 7, for example once a continuous voltage corresponding to the voltage of the source applied to the pair of power supply wires 10 has been stabilized at the terminals of the capacitance C.

Under such conditions, the current Iout leaving the stage P is practically entirely absorbed as Idriver current by the driver D; the difference (Iref peak−Isense, with Isense=Idriver) generated by the difference node 24 is always at a high level, such as to ensure that the switch $T_B$ remains stably closed. Under such conditions the pre-charge state P is in fact "transparent" optimizing the power flow to the driver D.

When the switch T is opened again, the switch $T_B$ may remain at a high level thus reducing the losses in the successive Ton cycle.

Figure 8:
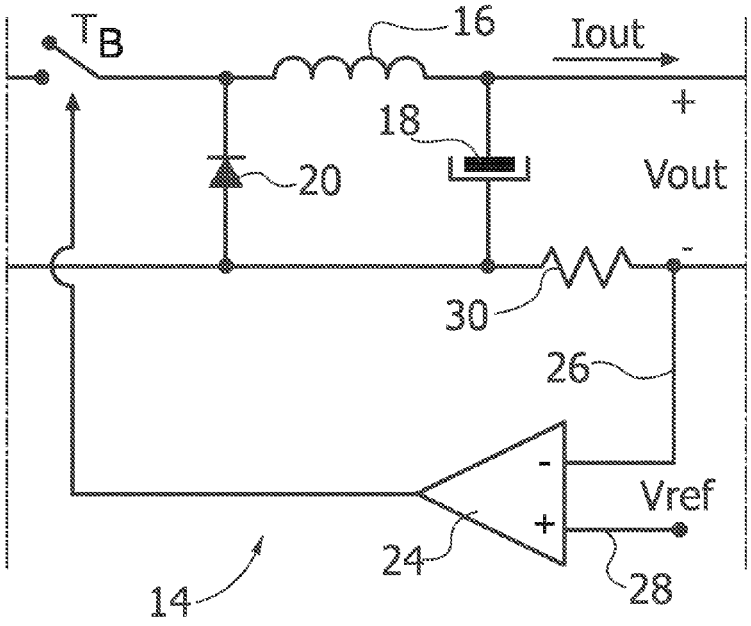
FIG. 8 illustrates another aspect of the disclosure.

FIG. 8 is a circuit diagram of a simplified, low-cost embodiment of the solution described with reference to FIGS. 5 and 6.

In the drawing in FIG. 8 the reference 30 indicates a sensing resistor that detects the intensity of the current Iout generating a corresponding signal Isense on the line 26.

The difference node 24 is implemented using a differential amplifier that receives:

- on the inverting input, the signal present on the line 26,
- on the non-inverting input, a reference voltage signal Vref indicative of the maximum threshold value of the current Ipeak ref.

The output of the comparator 24 can be used to directly drive the switch $T_B$, which can be implemented using a MOSFET.

By way of example, when the MOSFET $T_B$ is closed, the output current in the stage P starts to increase (beginning of gradient in diagram c) of FIG. 7) with an angular coefficient defined by the value of the inductor 16 and the input and output voltages. When the voltage at the inverting input of the comparator 24 reaches the value Vref, the output of the comparator changes from "high" to "low".

This often occurs with a typical delay of the comparator and, during this delay, the current continues to increase until the output of the comparator 24 changes causing the opening of the MOSFET $T_B$, causing the output current to begin to drop.

As a result, the voltage at the inverting input of the comparator 24 also drops down again to the value present on the non-inverting input (voltage Vref) such as to cause, in all cases with the intrinsic delay of the comparator 24, a new change of the output level, with the consequent switching of the MOSFET $T_B$ to a conductive state.

In other words, the comparator 24 is configured to detect the instant in which the intensity Isense of the charge current reaches (rising and falling, in the sample embodiment considered here) the value Ipeak ref and to command the switching of the control switch $T_B$ with a delay with respect to said instant.

Repeating this opening/closing mechanism of the switch represented by the MOSFET $T_B$ substantially determines the regulation of the current Iout with an average value linked to the voltage Vref and a ripple proportionate to the response delay of the comparator 24 (which induces an hysteresis mechanism in the switching having a stabilizing effect).

In full operation (capacitance C fully charged), with a current Idriver in the charge (driver D) below the maximum value admitted for the charge current, the MOSFET $T_B$ remains stably closed enabling the normal transfer of the power supply to the driver D (until the switch T is opened).

In the embodiments considered here, the switch T and the switch $T_B$ occupy different positions in the circuit as a whole. As stated above, in one embodiment, the function of the switch $T_B$ (for example MOSFET) may be in fact integrated into the function of the switch T, providing for the adjustment function of the charge current of the capacitance C represented by the rapid opening/closing sequence of the switch $T_B$ illustrated in diagram d) of FIG. 7 to be part of the drive function of the switch T as implemented in the section of the period Ton in which the PWM signal that drives the dimming function of the source S is such as to make the switch T conductive ("on" state).

Figure 9:
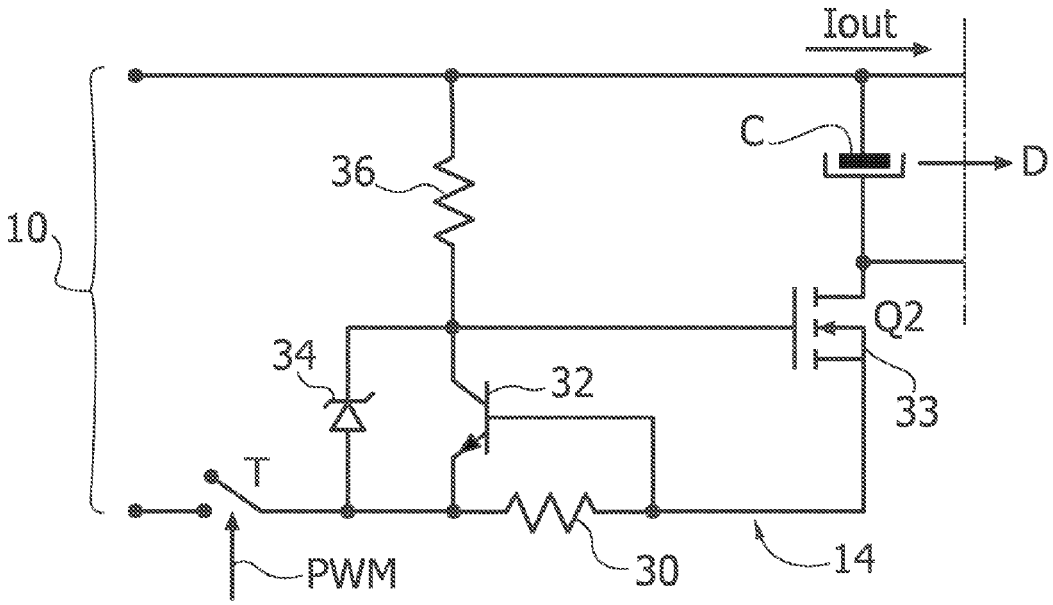
FIG. 9 illustrates another aspect of the disclosure.

In the embodiment shown in FIG. 9 (in which again parts, elements and components similar or equivalent to those already described are indicated using the same references) a control function similar to the one described above, instead of having a "digital" method of turning the switch represented by the MOSFET $T_B$ on and off, is actuated by using a MOSFET 33 as an analogue controller, i.e. as a current modulator.

In the embodiment shown in FIG. 9, the resistor 30 that acts as the sensor to detect the intensity of the charge current Iout is again present. The MOSFET 33 acts as a current modulator interposed on the power supply line and driven by the sensor 30 to modulate the charge current Iout as a function of the intensity detected by the sensor 30 itself, limiting the charge current again as a function of a value Ipeak ref.

For this purpose, the MOSFET 33 (here an n channel type) is connected such that the current Iout flows through its source-drain line. The gate of the MOSFET 33 is connected to an electronic switch 32, including, in the sample embodiment shown, an n-p-n bipolar transistor. The sensing resistor 30 (which detects the intensity of the current Iout) is here connected between the base and the emitter of the transistor 32 itself. A Zener diode 34 is then connected via its cathode and its anode, respectively, to the collector and the emitter of the transistor 32.

The power flow to the driver D is as before controlled, using PWM, by the switch T that, in the same embodiment illustrated, is connected to the anode of the Zener diode 34 as well as to the emitter of the transistor 32.

The MOSFET 33 has, as shown, its source-drain line crossed by the current Iout and is connected via its gate to the common connection point of the collector of the transistor 32 and of the cathode of the Zener diode 34. This common connection point is then connected via a resistor 36 to the "high" wire of the power supply line 10.

In the case of the embodiment in FIG. 9, when the switch T is closed at the beginning of the period Ton, the gate voltage of the MOSFET 33 is at a high level and the MOSFET 33 is inhibited, with the gate voltage of the MOSFET 33 clamped to the Zener value of the diode 34, chosen such as to maintain this voltage at a level below the maximum gate-source voltage permitted for operation of the 33.

As soon as the switch T is closed, the current Iout begins to increase charging the capacitance C and causing a corresponding increase in the voltage detected at the terminals of the sensing resistor 30. When this voltage reaches the base-emitter threshold voltage $Vbe_{on}$ of the bipolar transistor 32, this transistor, initially inhibited, starts to conduct drawing current across its collector and causing (as a result of the increase of the voltage drop across the resistor 36) a reduction in the gate voltage of the MOSFET 33. The MOSFET 33 is then operating in its linear operating region and acts as a controlled-voltage current modulator or regulator, limiting as before the charge current flowing through it.

The resistance value of the resistor 30 is chosen such as to make the switch 32 conductive and to trigger the regulation action of the MOSFET 33 such as to limit the peak value of the charge current of the capacitor C to a given maximum value. By way of example, increasing the resistance value of the resistor 30 results in a reduction of the value of the current Iout that triggers the modulation action of the MOSFET 33, and therefore a consequent reduction of the maximum value reached by the charge current Iout.

Again, when the full-operation conditions are reached (capacitance C fully charged) the operation of the circuit stabilizes in a rated condition causing (with the maximum peak value admitted for the inrush current greater than the rated charge current Iout=Idriver of the charge in normal operation) the voltage at the terminals of the resistor 30 to be lower than the voltage $Vbe_{on}$ which causes the bipolar transistor 32 to become conductive. In the aforementioned full-operation conditions, the transistor 32 is inhibited, while the MOSFET 33 is entirely conductive.

Again in this case, once the transient of the inrush current has been contained at the desired value, the pre-charge stage P is transparent in terms of normal operation of the circuit.

It will be seen that the solution described here makes it possible to implement fully effective, low-cost two-wire dimming. It is also possible to use the pre-charge stage P for any power range and, potentially, also to drive additional D units.

The pre-charge stage described, intended to manipulate the conditions in which it is possible to determine an excessively high inrush current, is in all other respects entirely transparent in the other operating phases of the circuit.

In various embodiments, the inventors have determined that the above mentioned inrush current can reach quite high intensity values, with the risk of damaging the switch T and/or the input capacitor or capacitors of the unit D. Moreover, if the power supply connected to the lines 10 is provided with protection against overloads, such a current could trigger the protection and interrupt the power supply.

Various embodiments are intended to overcome these potential drawbacks.

According to various embodiments, this scope is achieved using a device having the features set out in the claims below.

Various embodiments also concern a corresponding method.

The claims are an integral part of the technical explanation provided herein in relation to various embodiments.

In one embodiment, the solution described here involves placing upstream of the driver a pre-charge stage capable of acting between the switch T and the capacitance C such as to limit the aforementioned current.

Notwithstanding the invention principle, the implementation details and the embodiments may therefore vary significantly from the descriptions given here purely by way of example, without thereby moving outside the scope of the invention, as defined in the attached claims.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A device for dimming a light source, said device comprising:

a two-wire power supply line having interposed therein a switch for controlling transfer of said power supply towards said light source;

a capacitance located downstream of said switch being traversed by a charge current as said switch is switched on, wherein said switch is opened and closed using a PWM dimming control signal;

a driver for driving said light source, wherein said capacitance is arranged at the input of said driver and supplies power to the driver when said switch is open, whereby when said switch is made conductive again an inrush current is applied to said capacitance;

a pre-charge stage interposed between said switch and said capacitance; said pre-charge stage being configured to limit said inrush charge current to a given value, wherein said pre-charge stage comprises:

a sensor configured to sense the intensity of said charge current;

a comparator configured to compare the intensity of said charge current as sensed by said sensor with said given value, a control switch interposed in said power supply line for driving by said comparator to interrupt said power supply to limit said charge current to said given value, so that in full operation, with a current leaving said pre-charge stage below said given value, said control switch remains stably closed enabling the normal transfer of power supply to said driver; and a buck converter to limit said inrush charge current to said given value.

2. The device of claim 1, wherein said pre-charge stage is configured to limit the average value of said charge current to a given value.

3. The device of claim 1, wherein said comparator is configured to detect the time instant where the intensity of said charge current reaches said given value and control switching of said control switch with a delay with respect to said instant.

4. The device of claim 1, further comprising: a buck converter interposed between said switch and said sensor.

5. The device of claim 4, wherein said control switch is arranged upstream of said buck converter.

6. The device of claim 4, wherein said buck converter comprises a low-pass LC module and a diode forming a $\pi$ configuration with the inductance and the capacity in said LC module.

7. The device of claim 1, wherein said pre-charge stage comprises: a sensor configured to sense the intensity of said charge current, a current modulator interposed in said power supply line and driven by said sensor to modulate said charge current as a function of the intensity thereof as sensed by said sensor thus limiting said charge current to a given value.

8. The device of claim 7, further comprising: an electronic switch, driven by said sensor to activate said current modulator when the intensity of said charge current reaches a given threshold.

9. The device of claim 8, wherein the electronic switch comprises a bipolar transistor.

10. The device of claim 1, wherein said sensor comprises a resistor traversed by said charge current.

11. The device of claim 7, further comprising: an electronic switch, driven by said sensor to activate said current modulator when the intensity of said charge current reaches a given threshold; wherein said electronic switch has at least one of the following features: said electronic switch is a bipolar transistor having said resistor interposed between the base and the emitter of said bipolar transistor, whereby said given threshold is a function of the resistance value of said resistor, a zener diode is arranged across said electronic switch to apply to said current modulator a constant modulation voltage when said electronic switch is open.

* * * * *